US006612764B2

(12) United States Patent
Dumler et al.

(10) Patent No.: US 6,612,764 B2
(45) Date of Patent: Sep. 2, 2003

(54) COSMETIC APPLICATOR UNIT

(75) Inventors: Norbert Dumler, Ansbach (DE); Dieter Wolfsgruber, Vestenburg (DE); Werner Fischer, Burk (DE)

(73) Assignee: Geka Brush GmbH, Bechhofen (DE)

( * ) Notice: Subject to any disclaimer, the term of this patent is extended or adjusted under 35 U.S.C. 154(b) by 0 days.

(21) Appl. No.: 10/288,435

(22) Filed: Nov. 6, 2002

(65) Prior Publication Data

US 2003/0053839 A1 Mar. 20, 2003

Related U.S. Application Data

(63) Continuation-in-part of application No. 09/919,909, filed on Aug. 2, 2001, now abandoned.

(30) Foreign Application Priority Data

Aug. 8, 2000 (DE) ..... 100 39 490

(51) Int. Cl.[7] ..... B43K 27/02

(52) U.S. Cl. ..... 401/18; 401/17; 401/25; 132/317; 132/314

(58) Field of Search ..... 401/17, 16, 18, 401/19, 20, 25, 195; 132/317, 314, 318, 313

(56) References Cited

U.S. PATENT DOCUMENTS

| | | | | | |
|---|---|---|---|---|---|
| 2,177,651 | A | * | 10/1939 | Harris | 401/17 |
| 2,902,041 | A | | 9/1959 | Bau | |
| 3,073,320 | A | * | 1/1963 | Seaver | 132/314 |
| 3,690,777 | A | | 9/1972 | Costa | |
| 5,509,742 | A | | 4/1996 | Balzarini | |
| 6,276,853 | B1 | | 8/2001 | Breindenbach et al. | |

FOREIGN PATENT DOCUMENTS

| | | | | |
|---|---|---|---|---|
| DE | 15 57 284 | A | 2/1966 | |
| DE | 32 25 535 | A1 | 7/1982 | |
| DE | 39 23 731 | A1 | 7/1989 | |
| DE | 197 33 290 | A1 | 8/1997 | |
| FR | 989522 | * | 9/1951 | 401/18 |
| GB | 1315639 | | 5/1973 | |

* cited by examiner

*Primary Examiner*—David J. Walczak
(74) *Attorney, Agent, or Firm*—Browdy and Neimark, P.L.L.C.

(57) ABSTRACT

In a cosmetic applicator unit that comprises two different applicators, each having a stem, the applicators being interconnected in the vicinity of the free ends of the stems, it is provided that each applicator is lodged in a reservoir; that each reservoir has a neck with an external thread; and that the necks are screwed into coupling members for interconnection of the two reservoirs.

5 Claims, 2 Drawing Sheets

COSMETIC APPLICATOR UNIT

This is a continuation-in-part of parent application Ser. No. 09/919,909, filed Aug. 2, 2001, now abandon.

BACKGROUND OF THE INVENTION

1. Field of the Invention

The invention relates to a cosmetic applicator unit comprising two different applicators, each having a stem, the applicators being interconnected in the vicinity of the free ends of the stems.

2. Background Art

A unit of the generic type is known from DE 197 33 290. The known cosmetic applicator unit comprises a narrow brush as an applicator and a wooden cosmetic pencil as another applicator. The two applicators are tightly joined to each other and the joint is covered by a metal decoration sleeve. This solution may be rather attractive esthetically, but it is also costly, because special filling machines are needed for filling a cosmetic product such as nail varnish or a mascara compound, and because manufacture and treatment of the metal sleeve are costly.

U.S. Pat. No. 5,509,742 teaches a similar unit with a mascara brush provided on one side and an applicator for a liquid eye makeup remover on the other side. Via a plug-type connection, the second applicator is joined to a coupling member which the brush is plugged in.

SUMMARY OF THE INVENTION

It is an object of the invention to further develop double applicator units of the generic type so that cosmetics, for instance mascara, may be filled in by the consumer, using conventional machines or supply tubes, and that the consumer has the possibility to use the two applicators individually or, when purchasing such a unit, to combine them individually, depending on personal requirements and demands.

According to the invention, this object is attained in that each applicator is lodged in a reservoir, in that each reservoir has a neck with an external thread and in that the necks are screwed into coupling members for the two reservoirs to be interconnected. Preferably, the coupling members are screw caps for closing the individual reservoirs.

The embodiment according to the invention provides a double pack, which is known per se, offering the additional profit that applicators of varying properties or for varying mascara products are made available. Moreover, the invention also enables the individual reservoirs to be handled and closed individually, it being possible to have the connection thereof implemented easily and at a low cost at works as well as by the consumer.

An especially simple design is attained by the first coupling member having a locking recess and the second coupling member having a locking projection.

On their surface area, the coupling members may be provided with encircling annular grooves of rectangular cross-sectional shape so that the separating area is hidden optically.

The applicators may be mascara brushes, cosmetic pencils, foam moldings or narrow brushes, which are the most important designs to be mentioned. A unit may combine applicators of the same species that have varying properties or applicators of entirely different species.

In keeping with another embodiment, provision is made for the coupling members to have external threads by which they are screwed into the internal thread of a coupling sleeve.

The coupling sleeve may be internally threaded continuously or only by sections.

The stems of the applicators may have handling sections which are designed to be simultaneously the closure of the reservoir.

The stems and the handling sections may be connectable or preferably snap-in lockable during assembly. By advantage, the handling portions are lodged in a longitudinal recess in the coupling members.

In keeping with another embodiment, provision is made for at least one of the coupling members to have an internal thread into which to screw an external thread of a closure cap for the reservoir.

Details of the invention will become apparent from the ensuing description of a preferred embodiment, taken in conjunction with the drawing.

DESCRIPTION OF THE PREFERRED EMBODIMENT

Figure 1:
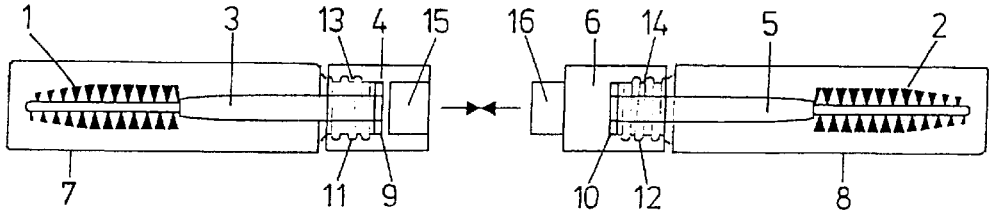
FIG. 1 is a longitudinal section through a first embodiment of a cosmetic applicator unit according to the invention with the two reservoirs not being interconnected.
Figure 6:
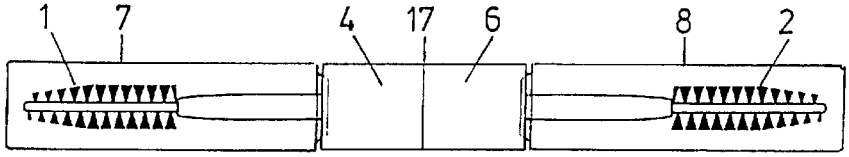
FIG. 6 is a view of the embodiment according to FIG. 1 when assembled.

An embodiment seen in FIGS. 1 and 6 comprises a first applicator 1 in the form of a mascara brush with thick bristles that are comparatively densely arranged, and a second applicator 2 in the form of a mascara brush with thinner bristles that are more densely arranged so that these two mascara brushes have varying properties of application.

The applicator 1 is mounted on a stem 3, which is again fixed to a first coupling member 4; the stem 5 of the second applicator 2 is joined to a second coupling member 6.

Each applicator 1, 2 is lodged in a cylindrical reservoir 7, 8—for liquid mascara in the exemplary embodiment—and each reservoir has a tapered neck 9, 10 with an external thread 11, 12, which can be screwed into a corresponding internal thread 13, 14 on the first and the second coupling member 4 and 6. In other words, the coupling members 4, 6 virtually are screw caps, individually closing the reservoirs 7, 8. Consequently, the two reservoirs 7, 8 including the respective applicators 1, 2 may be individually offered for sale and selected by a customer.

For the production of an assembled unit, the coupling member 4 has a locking recess 15 into which to insert a locking projection 16 of the second coupling member 6 so that the lateral view seen in FIG. 6 results, having a separating line 17 between the two coupling members 4, 6.

Figure 2:
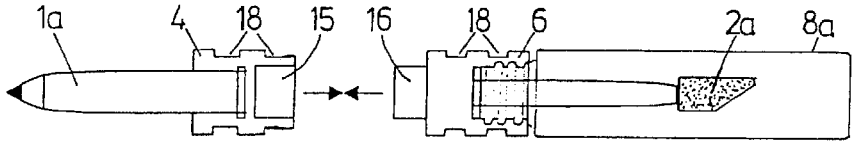
FIG. 2 is a sectional view through a varied design of the embodiment according to FIG. 1.

FIG. 2 illustrates a varied design with a cosmetic pencil as a first applicator 1*a* and a foam molding as a second applicator 2*a*. In this case, the reservoirs (of which only the reservoir 8*a* is seen) do not serve for holding a cosmetic; rather, they are protective sleeves for the applicators 1*a*, 2*a*.

Figure 10:
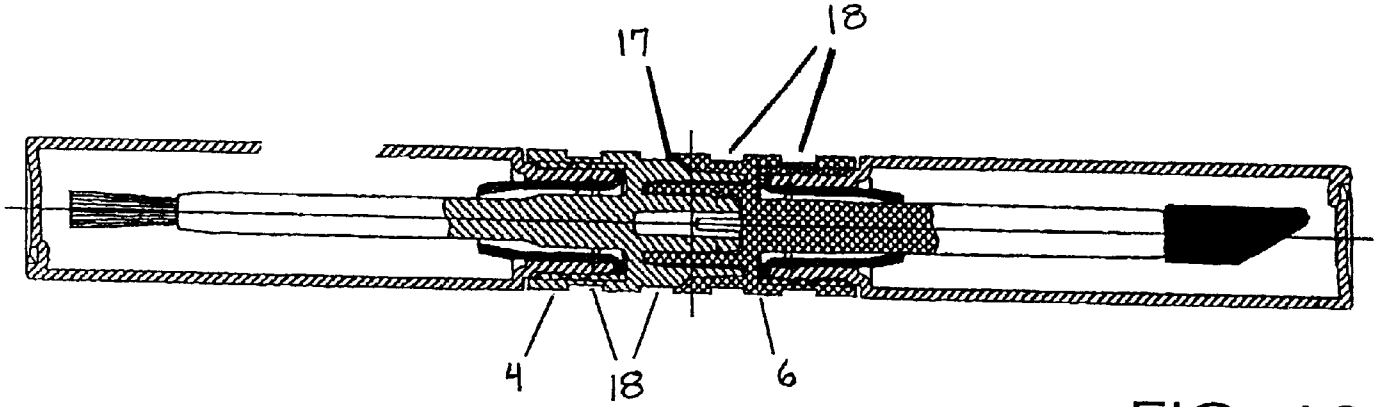
FIG. 10 is a sectional view through a varied design of the embodiment according to FIG. 1.
Figure 11:
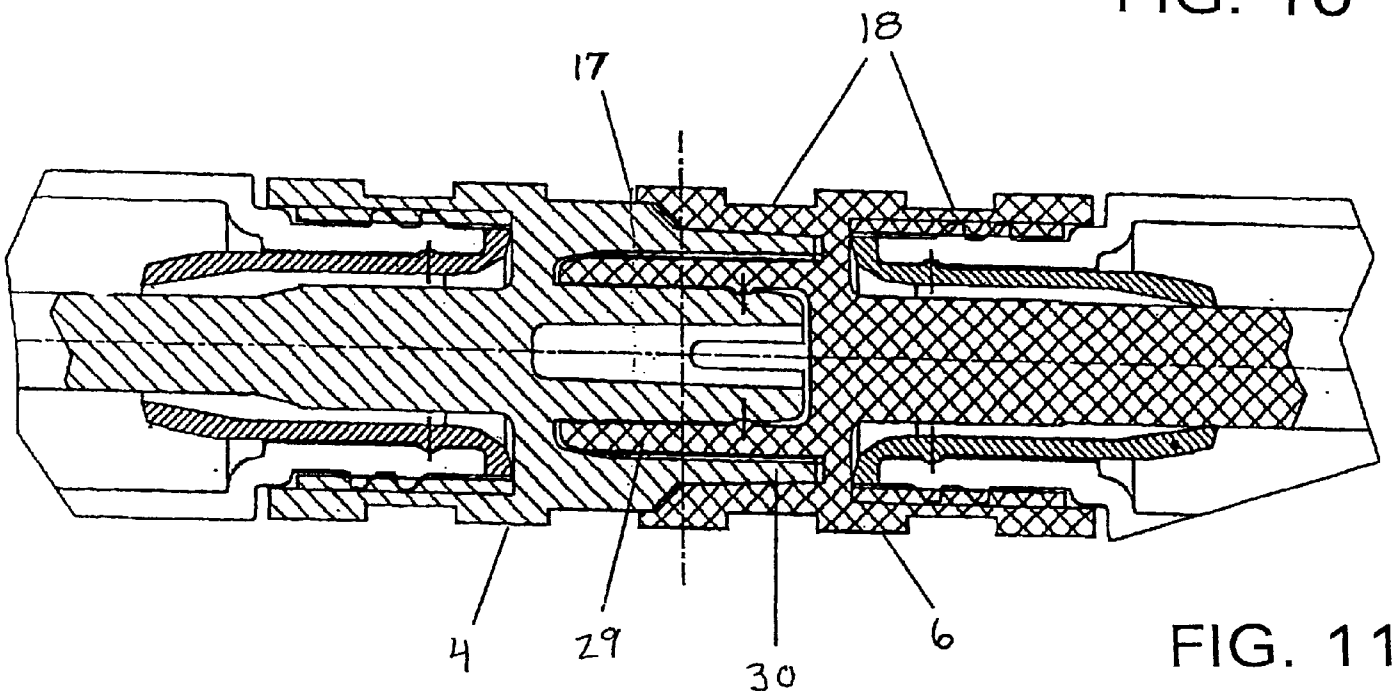
FIG. 11 is an enlarged sectional view of a portion of the varied design of FIG. 8.

In the variant design of FIG. 2 shown in FIGS. 10 and 11 as well as in FIG. 2, the coupling members 4, 6 have grooves 18 that encircle on their surface area, with the separating line 17 between the coupling members 4, 6 running in the vicinity of a lower edge of the bottom of a groove. This results in the separating line 17 being hidden optically.

In the design of FIGS. 10 and 11 the coupling members are engaged together in a different manner than that of FIG. 2. As shown in these figs. each have an annular groove 29, 30 which are formed to overlap when engaged to hold the coupling members 4, 6 together.

Figure 3:
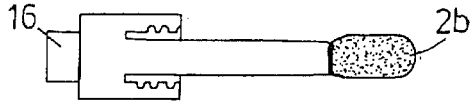
FIGS. 3 to 5 are illustrations of various designs of applicators for the first exemplary embodiment.
Figure 4:
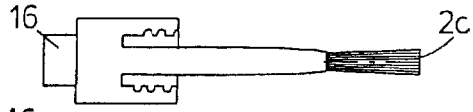
Figure 5:
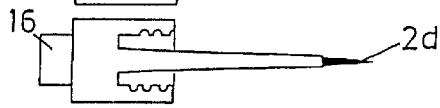

FIGS. 3 to 5 illustrate various designs of the second applicator 2, which may be a foam molding 2*b* according to FIG. 3, a comparatively wide nail varnish brush 2*c* according to FIG. 4 and a fine and narrow cosmetic brush 2*d* according to FIG. 5.

Figure 7:
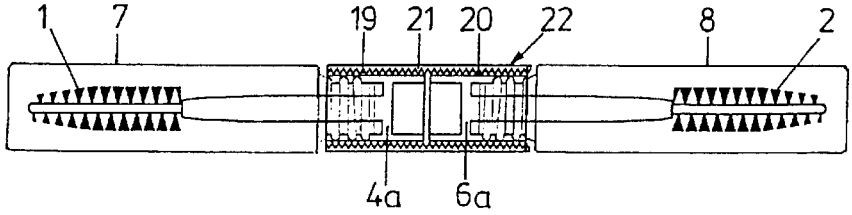
FIGS. 7 to 9 are longitudinal sections through three further embodiments.
Figure 8:
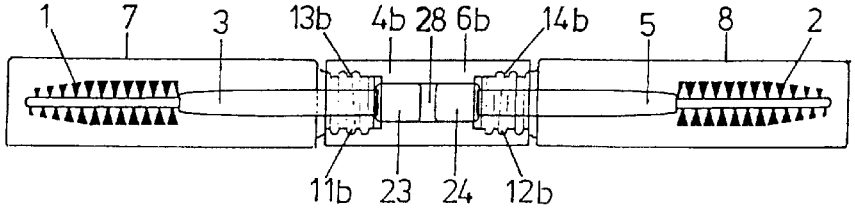
Figure 9:
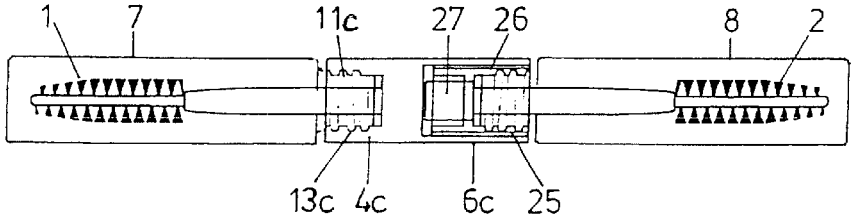

In the embodiments seen in FIGS. 7 to 9, the applicators 1, 2 and the reservoirs 7, 8 correspond to those of the first embodiment with however the coupling members being designed differently.

In the embodiment according to FIG. 7, the coupling members 4*a*, 6*a* are identical and—in the way already specified—they have an internal thread 13, 14 for the external thread 11, 12 to be screwed into upon attachment to the respective reservoir 7, 8. For interconnection of the two reservoirs 7, 8 and coupling members 4*a*, 6*a*, each coupling member has an external thread 19, 20 to be screwed into the internal thread 21 of a coupling sleeve 22. In this embodiment too the reservoirs 7, 8 may be filled individually by conventional machines; they may be offered, purchased and combined individually, depending on a consumer's demands.

In the embodiment according to FIG. 8, a single-piece coupling member is provided, having coupling-member sections 4*b*, 6*b*; each coupling-member section 4*b*, 6*b* has an internal thread 13*b*, 14*b*, into which to screw external threads 11*b*, 12*b* of the reservoirs 7, 8.

The stems 3, 5 are equipped with handling sections 23, 24 which enable the applicator 1, 2 to be pulled out of the respective reservoir 7, 8 and simultaneously close and seal the opening of the neck 9, 10.

In the embodiment according to FIG. 9, again a single-piece coupling member is provided, in which the coupling-member section 4*c* has an internal thread 13*c* for the thread 11*c* of the reservoir 7, whereas the coupling section 6*c* has a fine internal thread 25 into which to screw an external thread 26 of a screw cap 27 which serves as a closure for the reservoir 8. The screw cap 27 may also have a locking recess corresponding to the locking recess 15 in the embodiment of FIG. 1 so as to be combined, in this way, with other coupling members or reservoirs.

What is claimed is:

1. A cosmetic applicator unit comprising two different applicators, each having a stem; wherein each applicator (1, 2) is lodged in a reservoir (7, 8); wherein each reservoir (7, 8) has a neck (9, 10) with an external thread (11, 12); and wherein the necks (9, 10) are respectively screwed into first and second coupling members (4, 6) which can be engaged to each other to connect the two reservoirs (7, 8); wherein the first and second coupling members (4, 6) are respectively associated with the reservoirs (7, 8) and respectively close the corresponding reservoir when the first and second coupling members are not connected; wherein said stems (3, 5) are respectively connected to said first and second coupling members (4, 6);

wherein the coupling members (4, 6) have annular grooves of a rectangular cross-sectional shape that encircle on surface areas thereof;

wherein one of the annular grooves is formed when the first and second coupling members are connected;

wherein a circumferential separating line between the first and second coupling members is located at a lowest edge at a bottom of the annular groove formed when the first and second coupling members are connected.

2. The cosmetic applicator unit according to claim 1, wherein the coupling members (4, 5) are screw caps for the reservoirs (7, 8).

3. The cosmetic applicator unit according to claim 1, wherein the first coupling member (4) has a locking recess (15) and the second coupling member (6) has a locking projection (16).

4. The cosmetic applicator unit according to claim 1, wherein the applicators (1, 2) are mascara brushes, cosmetic pencils, foam moldings or narrow brushes.

5. The cosmetic applicator according to claim 1, wherein the first coupling member (4) has a first annular groove (29) and the second coupling member (6) has a second annular groove (30), wherein the first annular groove and the second annular groove overlap when engaged so as to hold the first and second coupling members together.

* * * * *